US011149625B2

(12) United States Patent
Koo

(10) Patent No.: US 11,149,625 B2
(45) Date of Patent: Oct. 19, 2021

(54) THEMOSTAT MISDIAGNOSIS PREVENTION METHOD AND ENGINE SYSTEM

(71) Applicants: HYUNDAI MOTOR COMPANY, Seoul (KR); KIA MOTORS CORPORATION, Seoul (KR)

(72) Inventor: Bon-Chang Koo, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 124 days.

(21) Appl. No.: 16/662,832

(22) Filed: Oct. 24, 2019

(65) Prior Publication Data

US 2020/0182125 A1 Jun. 11, 2020

(30) Foreign Application Priority Data

Dec. 10, 2018 (KR) ..... 10-2018-0158309

(51) Int. Cl.
*F01P 11/16* (2006.01)
*F01P 5/02* (2006.01)

(52) U.S. Cl.
CPC ..... *F01P 5/02* (2013.01); *F01P 11/16* (2013.01); *F01P 2025/62* (2013.01); *F01P 2025/66* (2013.01); *F01P 2031/00* (2013.01); *F02D 2200/0414* (2013.01)

(58) Field of Classification Search
CPC ..... F02D 41/18; F02D 41/185; F02D 41/187; F02D 41/22; F02D 41/221; F01P 2031/00; F01P 2031/20; F01P 2031/32
See application file for complete search history.

(56) References Cited

U.S. PATENT DOCUMENTS 6,161,767 A * 12/2000 Yeo ..... F01P 11/16 123/41.09
6,321,696 B1 * 11/2001 Nishioka ..... F01P 11/16 123/41.15
2002/0088274 A1 * 7/2002 Oka ..... F01P 11/14 73/114.71

FOREIGN PATENT DOCUMENTS

KR 2003-0030531 A 4/2003
KR 20040038007 A * 5/2004
KR 20060004114 A * 1/2006

* cited by examiner

*Primary Examiner* — Michael A Kessler
(74) *Attorney, Agent, or Firm* — McDonnell Boehnen Hulbert & Berghoff LLP

(57) ABSTRACT

A thermostat misdiagnosis prevention method applied to an engine system of the present disclosure applies high speed/high load and low speed/low load, which are divided by a vehicle speed and an engine output detected from the engine system at an engine warm-up temperature of engine coolant, as monitoring conditions of a thermostat, and determines thermostat fail by primarily determining the thermostat fail with the engine coolant temperature of the engine coolant temperature and the outside air temperature detected from the engine system, then confirming a delay time with respect to the outside air temperature, and secondarily determining the thermostat fail with the engine coolant temperature in a monitoring ECU, thereby corresponding to the enhanced OBD together with preventing the misdiagnosis of the thermostat by the fail-safe according to the primary and secondary determinations.

14 Claims, 7 Drawing Sheets

Tt: TARGET TEMPERATURE, Tw: WARM-UP TEMPERATURE, Td: DIAGNOSIS TEMPERATURE(THRESHOLD), Mect: MODEL ECT, Aect: ACTUAL ECT,
A-1: HERMOSTAT PRIMARY WARM-UP DIAGNOSIS PASS
A-2: HERMOSTAT CONTINUOS DIAGNOSIS SECONDARY PASS
B: SECONDARY FAIL, C-1: POSITIVE(COUNT UP), C-2: NEGATIVE(COUNT UP)

THEMOSTAT MISDIAGNOSIS PREVENTION METHOD AND ENGINE SYSTEM

CROSS-REFERENCE TO RELATED APPLICATION

This application claims priority to Korean Patent Application No. 10-2018-0158309, filed on Dec. 10, 2018, which is incorporated herein by reference in its entirety.

BACKGROUND

Field of the Disclosure

The present disclosure relates to thermostat diagnosis, and more particularly, to an engine system in which thermostat misdiagnosis is prevented by primary and secondary verification diagnosis procedures using a fail-safe.

Description of Related Art

Generally, a vehicle engine improves fuel efficiency by increasing the engine thermal efficiency at the engine temperatures that maintain engine warm-up temperatures (e.g., in a range of about 75° C. to 85° C.). For this purpose, a vehicle maintains the engine warm-up temperature by using an air-cooled or water-cooled cooling system.

Particularly, in the water-cooled cooling system, a thermostat is applied to control the coolant temperature, and the thermostat operates as an opening/closing valve for control coolant circulation at a target regulating temperature (85° C.).

For example, the thermostat opens a coolant circulation path so that the high temperature coolant circulates from an engine to a radiator when the temperature of the coolant according to the engine operation increases by the target regulating temperature (85° C.) or more, thereby lowering the temperature of the coolant by the heat exchange action of the radiator. Similarly, the thermostat closes the coolant circulation path when the temperature of the coolant becomes smaller than the target regulating temperature (85° C.), thereby maintaining the engine temperature in the warm-up state.

Therefore, the fail opening of the thermostat occurring at the temperature smaller than the target regulating temperature set in the water-cooled cooling system makes it impossible to maintain the engine warm-up temperature due to the continuation of the coolant circulation of the engine and the radiator, thereby increasing fuel consumption while reducing the engine heat efficiency. As described above, the normal opening and closing operation of the thermostat is very important in the water-cooled cooling system, and the normal state of the thermostat for verifying it is determined by the engine temperature monitoring control.

For example, the engine temperature monitoring control is a method for determining that the open fail of the thermostat has occurred when the engine coolant temperature maintains the temperature smaller than the engine warm-up temperature even after a certain time has elapsed since the engine started.

Therefore, the water-cooled cooling system maintains the engine thermal efficiency in the normal operating state of the thermostat for maintaining the engine warm-up temperature, thereby preventing the overcooling of the engine that is the cause of reducing fuel efficiency.

The contents described in Description of Related Art are to help the understanding of the background of the present disclosure, and may include what is not previously known to those skilled in the art to which the present disclosure pertains.

The engine temperature monitoring control is a method of having a limitation that it is not free from the thermostat misdiagnosis because it is a method of simply considering only the air amount of the engine (e.g., the intake air amount) as a thermostat fail factor.

For example, even if the occurrence of the open fail of the thermostat is determined from the result of the engine temperature monitoring control, the engine coolant temperature is inevitably increased in the low speed and low load traveling conditions in which the air circulation inside the engine is weak and thereby the engine is not cooled well. Therefore, the fail diagnosis is no longer performed because the result of the engine temperature monitoring control determines that the thermostat is a normal again.

Therefore, the engine temperature monitoring control is missed by the thermostat misdiagnosis, and the thermostat misdiagnosis causes the engine temperature not to maintain an optimum temperature (comport temperature required for any activity or the state maintenance) due to a valve open stuck state upon traveling, thereby deteriorating an exhaust gas at a low temperature.

In addition, the engine temperature monitoring control has a logical limitation that it is not possible to perform the fail diagnosis again in the thermostat misdiagnosis state where it has been determined that the open fail of the thermostat is a normal.

SUMMARY

Therefore, an object of the present disclosure considered the above is to provide a method for preventing thermostat misdiagnosis and an engine system, which may continuously monitor the thermostat opened and closed for the engine coolant circulation of the engine even after reaching the engine warm-up temperature, thereby preventing misdiagnosis by the fail-safe for the thermostat operation diagnosis, and particularly, may verify and diagnose the failure of the thermostat through the traveling conditions of the high speed/high load distinguished from the low speed/low load in which the air circulation inside the engine is weak by the primary and secondary determinations, thereby corresponding to the enhanced On Board Diagnostics (OBD) while preventing the thermostat misdiagnosis.

A thermostat misdiagnosis prevention method of the present disclosure for achieving the object includes controlling engine warm-up determination for an engine, and when the warm-up of the engine has been completed, controlling thermostat fail determination entry by an engine load-based load cumulative air amount and controlling thermostat fail determination by the confirmation of thermostat fail are performed by a monitoring ECU upon operation of an engine system.

In a preferred embodiment, the monitoring ECU applies the thermostat monitoring starting with a thermostat enable monitoring flag to control the thermostat fail determination entry. The thermostat is switched to a valve open by setting the engine warm-up temperature as a target regulating temperature, and the thermostat fail is detected in the valve open position.

In a preferred embodiment, controlling the thermostat fail determination entry includes dividing the engine system into high speed/high load and low speed/low load by engine information to apply the engine load-based load cumulative air amount. In addition, the controlling the thermostat fail determination confirms the thermostat fail by two determinations with the engine information.

In a preferred embodiment, as the engine information, at least one of an engine RPM, an engine output, an intake air amount, a vehicle speed, an outside air temperature, an engine coolant temperature, engine combustion, and an engine temperature is detected by the monitoring ECU in the engine system.

In a preferred embodiment, the vehicle speed and the engine output are applied to divide the high speed/high load and the low speed/low load in the controlling the thermostat fail determination entry, and the engine coolant temperature and the outside air temperature are applied to the primary and secondary determinations for the thermostat fail in the controlling the thermostat fail determination.

In a preferred embodiment, the controlling the thermostat fail determination entry includes determining the load cumulative air amount by using a positive cumulative air amount according to the high speed/high load and a negative cumulative air amount according to the low speed/low load, and the controlling the fail determination entry when the load cumulative air amount exceeds a specific value.

In this case, the determining the positive cumulative air amount includes determining whether to satisfy a first intake air amount corresponding to the high speed/high load conditions and updating the positive cumulative air amount by using the first intake air amount when satisfying the first intake air amount, and the determining the negative cumulative air amount includes determining whether to satisfy a second intake air amount corresponding to the low speed/low load conditions and updating the negative cumulative air amount by using the second intake air amount when satisfying the second intake air amount.

Therefore, the load cumulative air amount is calculated by a difference value between the positive cumulative air amount and the negative cumulative air amount applying a correction factor, respectively, and the determining the load cumulative air amount compares the difference value with a threshold.

In another preferred embodiment of the controlling the thermostat fail determination entry, it performs dividing into applying a high operation load of the positive cumulative air amount according to the high speed/high load and applying a low operation load of the negative cumulative air amount according to the low speed/low load in the engine warm-up temperature arrival state, and replacing the intake air amount supplied to the engine system with the load cumulative air amount. The engine warm-up temperature arrival is confirmed by the detected actual engine coolant temperature. The applying the high operation load is divided into confirming whether to satisfy the positive air amount condition by the vehicle speed and the engine output satisfying the high speed/high load, and calculating the positive cumulative air amount in order to replace the intake air amount, and the applying the low operation load is divided into confirming whether to satisfy the negative air amount condition by the vehicle speed and the engine output satisfying the low speed/low load, and calculating the negative cumulative air amount in order to replace the intake air amount.

In this case, each of the vehicle speed and the engine output is compared with a threshold. The calculating the positive cumulative air amount is performed by a sum of the intake air amount and a positive cumulative air amount storage value, and the sum is switched by an increase in a load cumulative counter in which the thermostat fail is diagnosed, and the calculating the negative cumulative air amount is performed by a subtraction of the intake air amount and the negative cumulative air amount storage value, and the subtraction is switched by a decrease in the load cumulative counter in which the thermostat fail is not diagnosed.

Therefore, the load cumulative air amount is calculated by a difference value between the positive cumulative air amount and the negative cumulative air amount applying a correction factor, respectively, and the difference value is compared with a threshold.

In a preferred embodiment, the controlling the thermostat fail determination includes performing primary determination for the thermostat fail with the engine coolant temperature, confirming the thermostat fail by the primary determination, determining thermostat fail determination grace condition satisfaction with a delay time according to the outside air temperature in the primary determination state, performing secondary determination for the thermostat fail with the engine coolant temperature, and determining the thermostat fail by the secondary determination.

In a preferred embodiment of the controlling the thermostat fail determination, the primary determination is performed by comparing the engine coolant temperature with a threshold of an On Board Diagnostics (OBD) thermostat diagnosis entry temperature. The determining the thermostat fail determination grace condition satisfaction is performed when the outside air temperature continues during a delay time. The secondary determination is performed by comparing the engine coolant temperature with a threshold of an On Board Diagnostics (OBD) thermostat diagnosis entry temperature.

On the other hand, the thermostat misdiagnosis prevention method of the present disclosure applies the high speed/high load and the low speed/low load of the engine system as the monitoring conditions of the thermostat at the engine warm-up temperature of the engine coolant by a monitoring ECU, and includes a thermostat fail-safe control for verifying thermostat fail through a two-step procedure by the monitoring of the thermostat.

Then, an engine system of the present disclosure includes a monitoring ECU for applying high speed/high load and low speed/low load, which are divided by a vehicle speed and an engine output detected after an engine warm-up temperature arrival of engine coolant, as monitoring conditions of a thermostat, and determining thermostat fail by primarily determining the thermostat fail with the engine coolant temperature of the detected engine coolant temperature and the outside air temperature, then confirming a delay time with respect to the outside air temperature, and secondarily determining the thermostat fail with the engine coolant temperature; and a water-cooled cooling system for circulating the engine coolant into an engine through an engine coolant line in which the thermostat is installed.

In a preferred embodiment, the monitoring ECU includes a monitoring block in which an enable monitoring flag starting the monitoring for the thermostat is generated, and the monitoring block receives engine information comprising an engine RPM, an engine load, an intake air amount, engine combustion, and an engine temperature together with the vehicle speed, the engine output, the engine coolant temperature, and the outside air temperature.

In a preferred embodiment, the monitoring ECU further includes an engine model block for generating a model engine temperature flag by the vehicle speed, the engine load, the outside air temperature, the engine combustion, and the engine temperature, and a fault detection block for determining the thermostat fail by detecting the engine coolant temperature while receiving the enable monitoring flag and the model engine temperature flag.

In a preferred embodiment, the monitoring ECU is connected with a thermostat diagnosis map, and the thermostat diagnosis map comprises the outside air temperature table, the low speed/low load table, the high speed/high load table, the monitoring table, and the thermostat fail diagnosis table.

The engine system of the present disclosure implements the following actions and effects by implementing the fail-safe for the thermostat operation diagnosis.

Firstly, it is possible to perform the continuous thermostat monitoring as to whether it reaches the target regulating temperature according to the engine warm-up temperature arrival even after it is primarily determined that the thermostat is normal, thereby implementing the fail-safe for the thermostat operation diagnosis. Secondly, it is possible to implement the diagnosis logic of determining the thermostat fail diagnosis at the descending point equal to or smaller than a certain temperature caused by the heat radiation after the engine coolant temperature is increased by performing the continuous thermostat monitoring. Thirdly, it is possible to prevent misdiagnosis through the diagnosis determination limited to the high load operation that excludes the low speed and low load traveling conditions, which cause the increase in the engine coolant temperature after the thermostat fail determination. Fourthly, it is possible to inherently prevent the phenomenon of the reduction in the engine thermal efficiency that is the cause of the reduction in fuel efficiency by preventing the thermostat misdiagnosis. Fifthly, it is possible to implement the system suitable for the North America OBD enhanced regulation for the Active Off-Cycle Credit requirement with respect to the 19MY (Auto Transmission Fluid (ATF)) warmer system as the item corresponding to the California Air Resources Board (CARB) regulation.

DETAILED DESCRIPTION

Hereinafter, exemplary embodiments of the present disclosure will be described in detail with reference to the accompanying drawings, and these embodiments are one example and various different forms may be made by those skilled in the art to which the present disclosure pertains, such that the present disclosure is not limited to the embodiments described herein.

Figure 1:
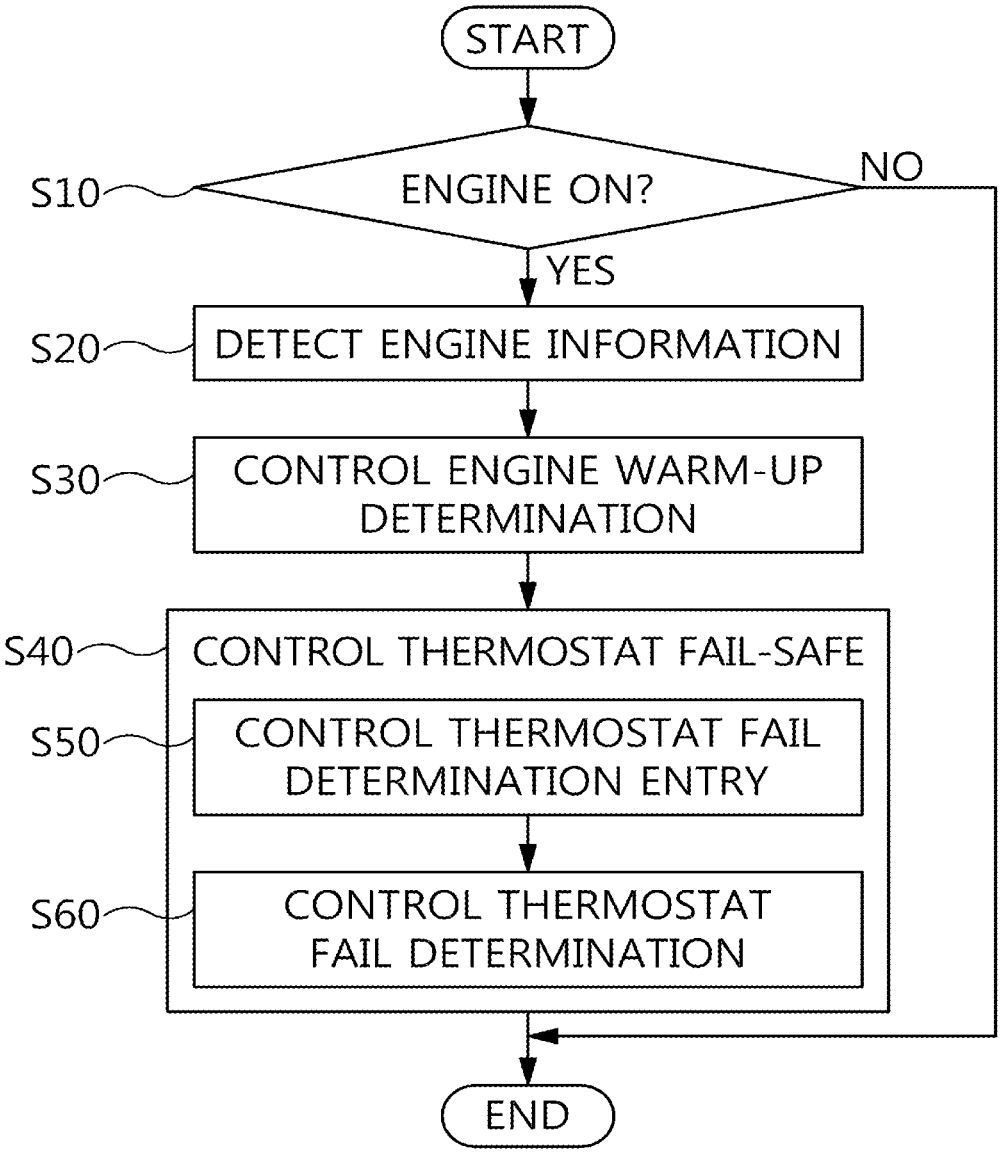
FIG. 1 is a flowchart illustrating a method for preventing thermostat misdiagnosis according to the present disclosure.

Referring to FIG. 1, a thermostat misdiagnosis prevention method performs determining engine warm-up through detecting engine information S20 upon operation of an engine system of an engine ON S10 by an engine warm-up determination control S30, and then a thermostat fail-safe control S40, thereby confirming and preventing thermostat misdiagnosis.

In addition, the thermostatic fail-safe control S40 is divided into entering thermostat fail determination through an engine load-based cumulative air amount performed by a thermostat fail determination entry control S50, and determining thermostat fail through an engine coolant temperature performed by a thermostat fail determination control S60.

As a result, the thermostat diagnosis prevention method is limited only to the arrival of the load accumulative counter according to the engine operation condition through the thermostat fail determination entry control S50 and the thermostat fail determination control S60 to perform the thermostat fail diagnosis, and therefore, the verification for the thermostat fail may be performed, thereby preventing the thermostat misdiagnosis caused by simply considering only the air amount (e.g., the intake air amount) of the engine as a thermostat fail factor as in the conventional control.

Figure 2:
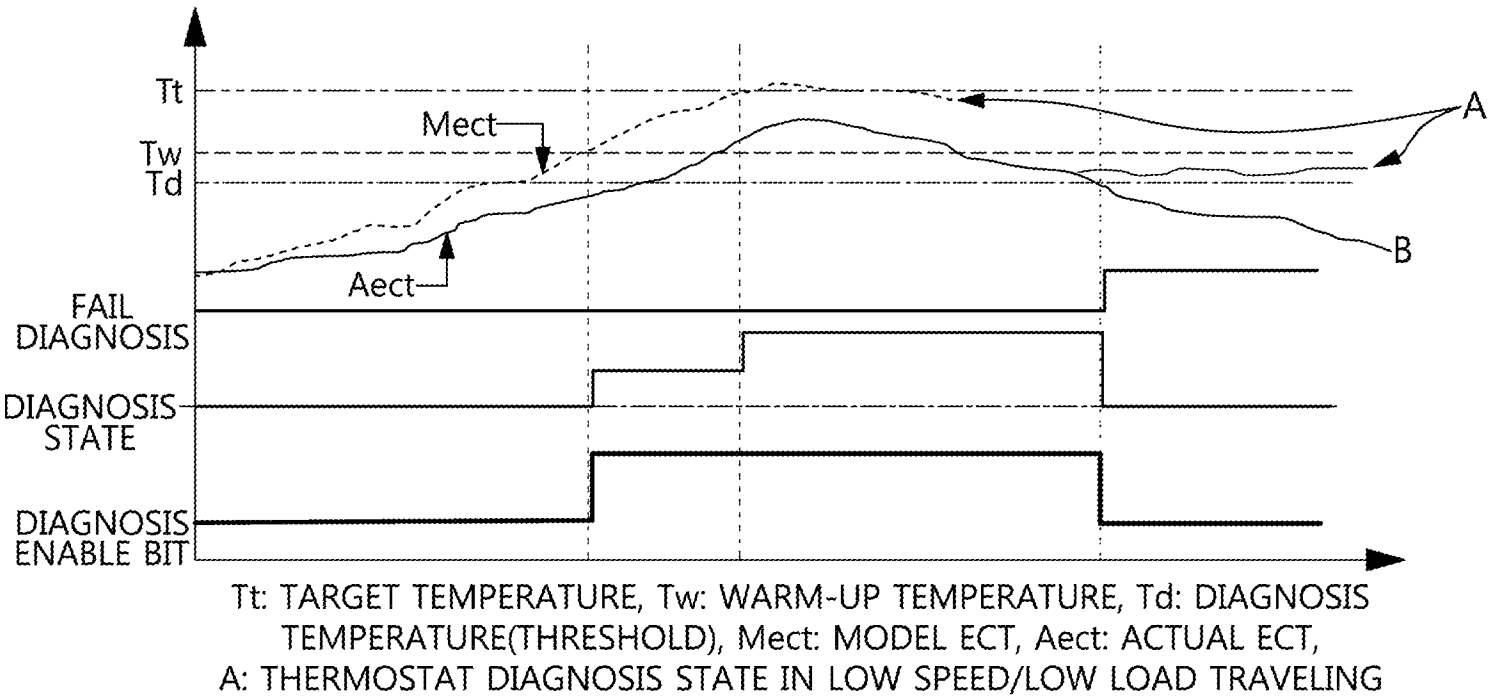
FIG. 2 is a diagram illustrating a state where the thermostat misdiagnosis is exemplified as the operating line diagram of an engine system according to the present disclosure.

Referring to FIG. 2, the influence of the thermostat misdiagnosis is exemplified in that the thermostat fail is again determined to be normal by increasing the engine coolant temperature by the weak air circulation inside an engine room in the low speed and low load traveling conditions by the engine system after the thermostat fail determination.

As illustrated, the conventional engine temperature monitoring control result shows the open fail confirmation of the thermostat (indicated by the solid line in FIG. 2 of the thermostat fail determination), but the engine temperature monitoring control result in which an increase in the engine coolant temperature has been reflected is switched to the thermostat normal confirmation (indicated by the dotted line in FIG. 2 of the thermostat normal determination). As a result, the thermostat is in an opened state, but the engine temperature monitoring control will no longer perform the fail diagnosis for the thermostat by wrongly determining the thermostat as normal.

Therefore, the thermostat diagnosis prevention method of FIG. 1 performs the continuous thermostat monitoring diagnosis entry condition determination by the thermostatic fail-safe control S40, thereby fundamentally preventing the deterioration phenomenon of the exhaust gas due to a low engine temperature equal to or smaller than a setting temperature caused by the valve open stuck of the thermostat as in FIG. 2.

Figure 3:
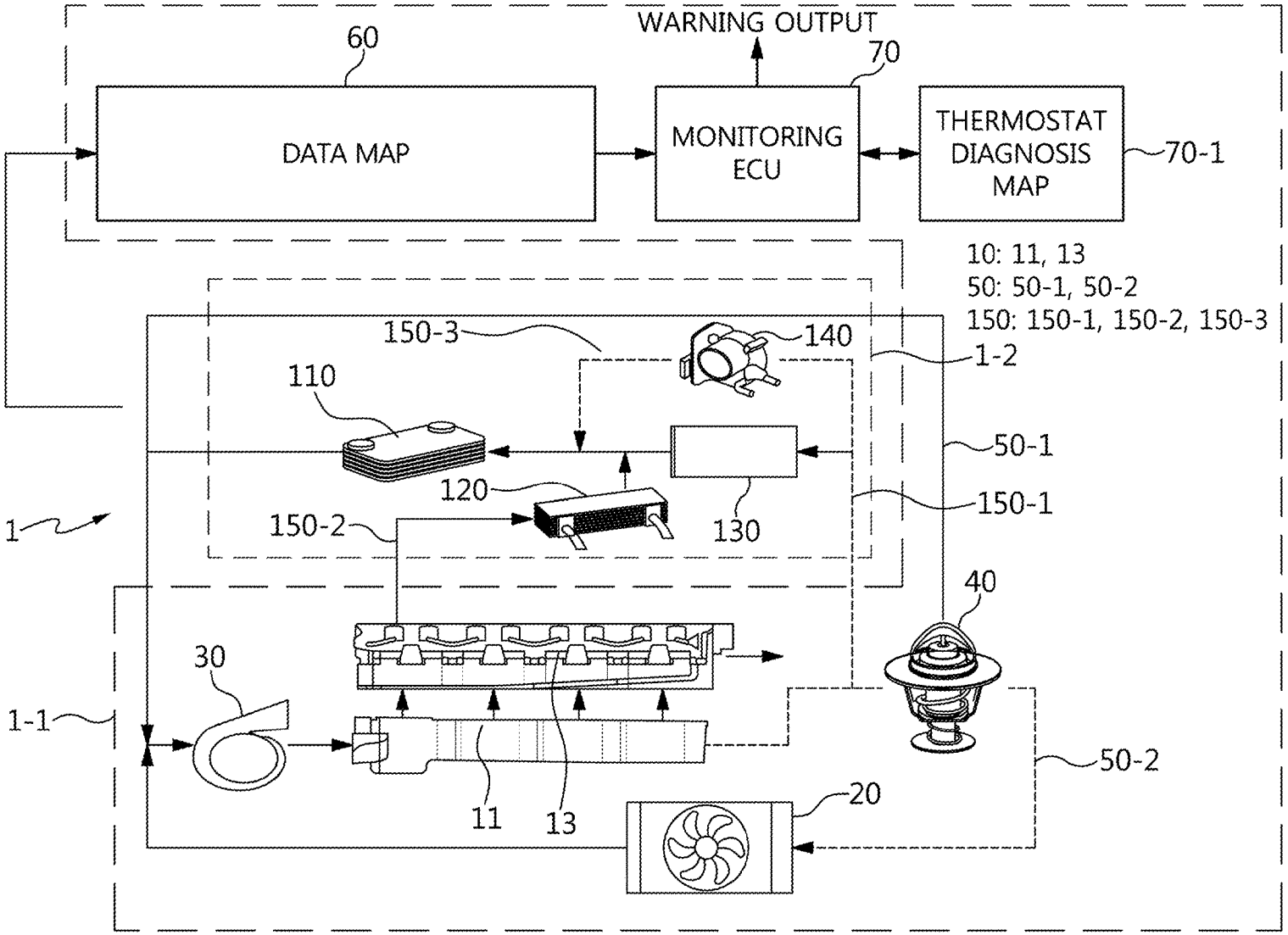
FIG. 3 is a diagram illustrating an example of the engine system in which a thermostat misdiagnosis prevention control is implemented according to the present disclosure.

Referring to FIG. 3, an engine system 1 includes a water-cooled cooling system 1-1 connected to an Auto Transmission Fluid (ATF) warmer system 1-2, and a monitoring ECU 70 connected to a data map 60 and a thermostat diagnosis map 70-1.

Specifically, the water-cooled cooling system 1-1 includes an engine coolant line 50 for forming an engine coolant circulation path through which coolant is sent to an engine 10 and then is discharged from the engine 10 through a cylinder body block 11 and a cylinder upper block 13, a radiator 20, a water pump 30, and a thermostat 40.

For example, the engine coolant line 50 is divided into an engine circulation line 50-1 for connecting the coolant inlet/outlet port (not illustrated) of the engine 10 to a closed circuit via the thermostat 40, and a radiator circulation line 50-2 for connecting the coolant inlet/outlet port (not illustrated) of the engine 10 to the closed circuit via the radiator 20, the water pump 30, and the thermostat 40. In this case, the engine circulation line 50-1 and the radiator circulation line 50-2 are connected to each other via the water pump 30 and the thermostat 40 to form the closed circuit.

For example, the radiator 20 is installed in the radiator circulation line 50-2 between the water pump 30 and the thermostat 40, and cools the high temperature engine coolant discharged from the engine 10. The water pump 30 is installed at the connection portion between the engine circulation line 50-1 and the radiator circulation line 50-2, and pumps the engine coolant under a control of an engine controller (or a monitoring ECU 70) to be circulated to the engine 10. The thermostat 40 is installed at the connection portion between the engine circulation line 50-1 and the radiator circulation line 50-2, and operates as an opening/closing valve for a coolant circulation control at a target regulating temperature (85° C.).

Specifically, the ATF warmer system 1-2 includes an ATF warmer 110, an Exhaust Gas Recirculation (EGR) cooler 120, a heater 130, an Electronic Throttle Control (ETC) 140, and an ATF coolant line 150.

For example, the ATF coolant line 150 is divided into an ATF circulation line 150-1 for connecting the engine 10 and the engine circulation line 50-1, an EGR cooler branch line 150-2 for connecting the engine 10 and the ATF circulation line 150-1, and an ETC branch line 150-3 for bypassing and connecting the ATF circulation line 150-1.

For example, the ATF warmer 110 is installed in the ATF circulation line 150-1 at the rear end position of the heater 130, and is provided as the heat exchange place of the Auto Transmission Fluid (ATF) (i.e., transmission oil) circulating with the engine coolant passing through the internal space thereof. The EGR cooler 120 is installed in the EGR cooler branch line 150-2 connected to the ATF circulation line 150-1 for connecting between the ATF warmer 110 and the heater 130, and lowers the temperature of the Exhaust Gas Recirculation (EGR) gas that is the supercharged exhaust gas. The heater 130 is installed in the ATF circulation line 150-1 at the front end of the ATF warmer 110, and heats the outside air with the high temperature engine coolant. The ETC 140 controls the intake air flow rate supplied to the engine 10.

Specifically, the monitoring ECU 70 processes the engine information detected in the data map 60 upon operation of the engine 10 as input data, and determines whether the thermostat 40 is a fail by matching the engine information with the table of the thermostat diagnostic map 70-1, and performs the thermostat misdiagnosis prevention control by the thermostat fail diagnosis procedure together with the operating state monitoring of the thermostat 40 while dividing the engine load of the engine system 1 into the low speed/low load and the high speed/high load conditions according to the engine information. Therefore, the thermostatic diagnosis map 70-1 has the outside air temperature table, the low speed/low load table, the high speed/high load table, the monitoring table, and the thermostat fail diagnosis table.

Figure 4:
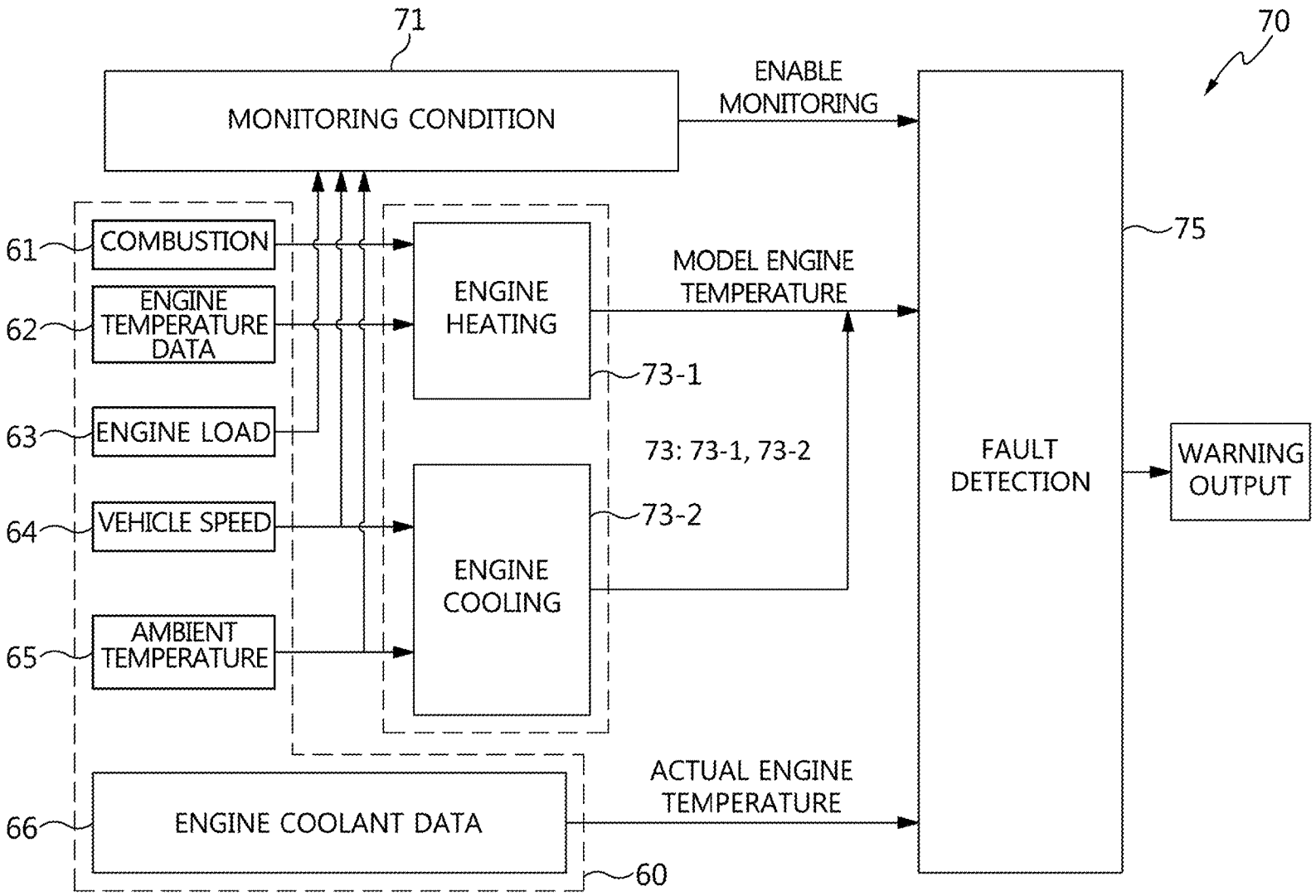
FIG. 4 is a diagram illustrating an input signal processing state for the thermostat continuous diagnosis of a controller upon operation of the engine system according to the present disclosure.

Referring to FIG. 4, the data map 60 obtains the engine information with the detection value of a vehicle mounting sensor, and the detection value of the vehicle mounting sensor is provided to the monitoring ECU 70 as the engine information divided into combustion data 61, engine temperature data 62, engine load data 63, vehicle speed data 64, ambient air data 65, and engine coolant data 66.

In addition, the monitoring ECU 70 is divided into a monitoring block 71 for outputting an enable monitoring flag, an engine model block 73 divided into a warm-up model of the engine warm-up model temperature 73-1 and an environmental model of the engine cooling environment by the outside conditions (i.e., vehicle speed and outside air temperature) 73-2 and for determining whether to reach the engine warm-up temperature according to the Model Engine Temperature to generate a flag, and a fault detection block 75 for determining whether it is a fail or a pass according to the open of the thermostat from a difference between the engine warm-up model temperature and actual engine coolant temperature upon detecting the enable monitoring flag.

Therefore, the monitoring ECU 70 performs diagnosis for the opening and closing state of the thermostat 40 together with the engine load of the low speed/low load and the high speed/high load conditions with respect to the operating state of the engine system 1 by using the engine information obtained from the data map 60.

Hereinafter, the thermostat misdiagnosis prevention method of FIG. 1 will be described in detail with reference to FIGS. 3 to 7. In this case, the control subject is the monitoring ECU 70, and the controlled object is a component of the water-cooled cooling system 1-1 including the engine 10 and the thermostat 40.

Referring to FIG. 1, the monitoring ECU 70 confirms the engine ON S10 for the engine warm-up determination control S30, and then performs the detecting the engine information according to the engine system operation S20. In this case, the engine ON S10 is performed by the Ignition ON by the key ON, and the detecting the engine information S20 means the operating state information of the engine system 1 by the detection value of the vehicle mounting sensor, and the engine warm-up determination control S30 means that the warm-up temperature for the engine coolant of the engine 10 reaches in a range of about 75 to 85° C. Therefore, the engine warm-up determination control S30 is an engine warm-up control such as a general method in which the engine coolant is rapidly heated in the closed state of the thermostat.

Referring to FIG. 4, the monitoring ECU 70 processes the engine information detected by the data map 60 as input data to confirm the engine ON by the Ignition ON by the key ON. In addition, the monitoring ECU 70 confirms the operating state of the engine system 1 according to the engine information of the data map 60.

For example, the combustion data 61 is a sensor detection value or a logic calculation value as a combustion state and a combustion temperature for each cylinder of the engine 10, and the engine temperature data 62 is a temperature sensor detection value for the temperature of the engine 10, the engine load data 63 is a logic calculation value using the intake air amount according to the engine RPM of the engine 10 and the opening of the accelerator pedal, the vehicle speed data 64 is a vehicle speed sensor detection value for the traveling speed of the vehicle, the ambient air data 65 is an outside air temperature sensor detection value for the ambient air around the vehicle, and the engine coolant data 66 is a temperature sensor detection value for the engine coolant for circulating the engine 10.

In addition, the monitoring ECU 70 uses the monitoring block 71, the engine model block 73, and the fault detection block 75 together with the basic function logic in the thermostat fail determination entry control S50 and the thermostat fail determination control S60. In this case, the basic function logic may be applied to the monitoring block 71.

For example, the basic function logic performs the engine system 1 with an operation load division in which the high operation load of the high speed/high load conditions and the low operation load of the low speed/low load conditions are determined, the load cumulative air amount calculation to which the positive cumulative air amount of the high operation load (i.e., high speed/high load) and the negative cumulative air amount of the low operation load (i.e., low speed/low load) are applied, and the like from the vehicle speed and the engine output.

For example, the monitoring block 71 confirms with the engine information provided in the combustion data 61, the engine temperature data 62, the engine load data 63, the vehicle speed data 64, and the ambient air data 65, and generates the thermostat enable monitoring flag (i.e., a monitoring status good signal) upon confirming the engine information to provide it to the fault detection block 75.

For example, the engine model block 73 confirms the target temperature arrival (i.e., engine warm-up) with the combustion data 61 and the temperature data 62 in the warm-up model 73-1, connects the engine room environment temperature with the vehicle speed data 64 and the ambient air data 65 in the environment model 73-2, and generates the engine warm-up model temperature reflecting the output of the environmental model 73-2 to the output of the warm up model 73-1 to provide it to the fault detection block 75.

For example, the fault detection block 75 continues the thermostat continuous diagnosis logic upon confirming the thermostat enable monitoring flag, and finally performs the flag output into which the thermostat fail (S65 of FIG. 6) and the thermostat normal (S66 of FIG. 6) are divided through the comparison between the engine warm-up model temperature and the actual engine coolant temperature.

Referring again to FIG. 1, the monitoring ECU 70 performs by dividing the thermostatic fail-safe control S40 into the thermostat fail determination entry control S50 and the thermostat fail determination control S60, thereby preventing the thermostat misdiagnosis through the thermostat diagnosis and verification by at least two-step procedure according to the engine load conditions of the engine system 1.

Particularly, the thermostat fail determination entry control S50 applies a load cumulative variable count that uses the positive cumulative air amount of the high speed/high load establishment conditions and the negative cumulative air amount of the high speed/high load non-establishment conditions (i.e., the low speed/low load conditions) as the load cumulative air amount. In addition, the thermostat fail determination control S60 prevents the thermostat misdiagnosis by applying the engine coolant temperature twice.

Hereinafter, the positive air amount is defined as the case that satisfies the engine heat-generating conditions as the high output/high speed operation conditions of the outside air temperature of 10° C. or more, the vehicle speed of 60 kph or more, and the engine torque of 30% or more. The negative air amount is defined as the case that satisfies the engine heat-dissipation conditions as the low output/low speed operation conditions of the outside air temperature of less than 10° C., the vehicle speed of less than 40 kph, and the engine torque of less than 10%. The load cumulative air amount is defined as the cumulative air amount that satisfies the condition for increasing the engine temperature.

Figure 5:
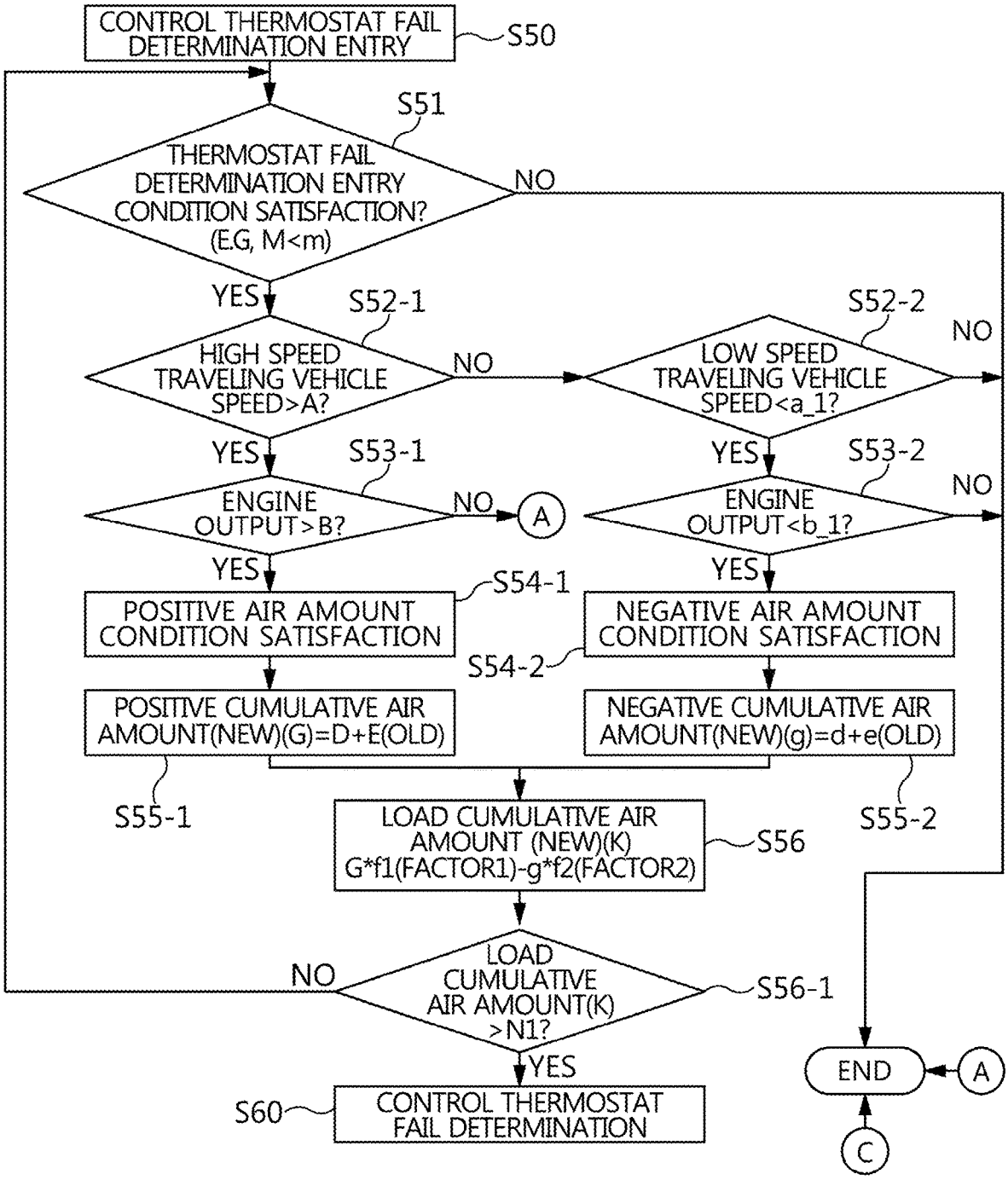
FIG. 5 is a flowchart illustrating a thermostat diagnosis control for the thermostat misdiagnosis prevention control according to the present disclosure.

Referring to FIG. 5, the monitoring ECU 70 performs the thermostat fail determination entry control with determining the thermostat fail determination entry condition satisfaction S51, applying the high operation load (i.e., a high load operation area) S52-1 to S55-1, applying the low operation load (i.e., a low load operation area) S52-2 to S55-2, and applying the load cumulative air amount S56 to S56-1. Particularly, the high speed/high load of the applying the high operation load S52-1 to S55-1 and the low speed/low load of the applying the low operation load S52-2 to S55-2 are applied as the monitoring conditions of the thermostat 40.

For example, the determining the thermostat fail determination entry condition satisfaction S51 is performed by the entry condition satisfaction equation using the actual engine coolant temperature of the engine coolant data 66 and the On Board Diagnostics (OBD) thermostat diagnosis entry temperature read from the fault detection block 75.

Entry condition satisfaction equation: $M<m$

Herein, "M" refers to the engine coolant temperature detection value of the engine coolant data 66 at the determination time point, and "m" refers to the threshold value set as the OBD thermostat diagnosis entry temperature having a specific value and is applied as the reference value.

As a result, since it is unnecessary to diagnose the thermostat fail when the coolant temperature M is high by setting the OBD thermostat diagnosis entry temperature m as the reference value in the determining the thermostat fail determination entry condition satisfaction S51, the thermostat fail determination entry control S50 is terminated. On the other hand, when the coolant temperature M is low by setting the OBD thermostat diagnosis entry temperature m as the reference value in the determining the thermostat fail determination entry condition satisfaction S51, the warm-up temperature of the actual engine coolant temperature is set to the possible state (i.e., pass state) to proceed with a procedure of determining the thermostat fail.

For example, the applying the high operation load S52-1 to S55-1 is performed with determining high speed traveling S52-1, determining an engine output S53-1, confirming positive air amount condition satisfaction S54-1, and calculating a positive cumulative air amount S55-1.

The determining the high speed traveling S52-1 applies a high speed determination equation and the determining the engine output S53-1 applies a high output determination equation.

High speed determination equation: vehicle speed>A

High output determination equation: engine output (or torque)>B

Herein, "vehicle speed" refers to the vehicle speed detection value of the vehicle speed data 64 at the determination time point, "engine output (or torque)" refers to the engine output or torque calculation value (or detection value) of the engine load data 63 at the determination time point, "A" refers to the threshold value and is set to the vehicle speed of about 60 kph, "B" refers to the threshold value and is set to the engine output or torque of about 30%, and ">" refers to an inequality indicating the magnitude of two values.

As a result, if the detected vehicle speed is greater than the threshold value A but the engine output (or torque) is smaller than the threshold value B, the thermostat fail diagnosis is not necessary, thereby terminating the thermostatic fail-safe control. However, when the detected vehicle speed is smaller than the threshold value A, it is switched to the applying the low operation load S52-2 to S55-2, while when the detected vehicle speed is greater than the threshold value A and the engine output (or torque) is greater than the threshold value B, the confirming the positive air amount condition satisfaction S54-1 is performed.

The calculating the positive cumulative air amount S55-1 applies the positive air amount calculation equation. In this case, the positive cumulative air amount may be defined as a first intake air amount corresponding to the high speed/high load conditions.

Positive air amount calculation equation: positive cumulative air amount G=D+E

Herein, "D" refers to the air amount detection value of an intake air sensor according to the opening of the ETC 140, "E" refers to the positive cumulative air amount storage value (e.g., the thermostat diagnosis map 70-1 or the storage value of a memory) before the positive air amount calculation time point, and "+" refers to the sum symbol of two values. Therefore, the positive air amount G is increased by the load cumulative counter, and a positive enable bit is generated at 1 in the procedure of increasing the load cumulative counter.

As a result, the positive cumulative air amount G renews (i.e., updates) the existing value by summing the existing value and the detected value when calculating the positive air amount.

For example, the applying the low operation load S52-2 to S55-2 is performed with determining low speed traveling S52-2, determining an engine output S53-2, confirming negative air amount condition satisfaction S54-2, and calculating a negative cumulative air amount S55-2.

The determining the low speed traveling S52-2 applies a low speed determination equation and the determining the engine output S53-2 applies a low output determination equation.

Low speed determination equation: vehicle speed<a_1

Low output determination equation: engine output (or torque)<b_1

Herein, "vehicle speed" refers to the vehicle speed detection value of the vehicle speed data 64 at the determination time point, "engine output (or torque)" refers to the engine output or torque calculation value (or detection value) of the engine load data 63 at the determination time point, "a_1" refers to a threshold value and is set to the vehicle speed of about 40 kph, "b_1" refers to a threshold value and is set to the engine output or torque of about 10%, and "<" refers to an inequality indicating the magnitude of two values.

As a result, when the detected vehicle speed is not smaller than the threshold value a_1 or the detected vehicle speed is smaller than the threshold value a_1 but the engine output (or torque) is not smaller than the threshold value b_1, it is determined that the engine 10 is not heated sufficiently to return to the engine warm-up control S30 or the control is terminated when it is determined that the engine 10 has been sufficiently heated. On the other hand, when the detected vehicle speed is smaller than the threshold value a_1 and the engine output (or torque) is smaller than the threshold value b_1, the confirming the negative air amount condition satisfaction S54-2 is performed.

The calculating the negative cumulative air amount S55-2 applies a negative air amount calculation equation. In this case, the negative cumulative air amount may be defined as a second intake air amount corresponding to the low speed/low load conditions.

Negative air amount calculation equation: negative cumulative air amount (g)=d+e Herein, "g" refers to the negative cumulative air amount at the determination point, "d" refers to the air amount detection value of the intake air sensor according to the opening of the ETC 140 at the determination time point, "e" refers to the negative cumulative air amount storage value (e.g., the thermostat diagnosis map 70-1 or the storage value of the memory) before the negative air amount calculation time point at the determination time point, and "+" refers to the sum symbol of two values.

As a result, the negative cumulative air amount g renews (i.e., updates) the existing value by summing the existing value and the detected value when calculating the negative air amount. Particularly, the negative air amount g is reduced by the load cumulative counter, and a positive enable bit is maintained at zero in the procedure of reducing the load cumulative counter.

This reason is for the continuous thermostat diagnosis logic through continuous monitoring of the thermostat to block the possibility that the normal thermostat 40 may wrongly be diagnosed to be a fail due to the reduction in the coolant temperature through the exclusion of the fail diagnosis when the traveling in the low speed/low load state is performed in a state where the thermostat 40 has normally been closed.

For example, the applying the load cumulative air amount S56 to S56-1 is divided into calculating a load cumulative air amount S56 and determining a load cumulative air amount S56-1.

The calculating the load cumulative air amount S56 applies a load cumulative air amount calculation equation and the determining the load cumulative air amount S56-1 applies a load cumulative air amount determination equation.

Load cumulative air amount calculation equation: load cumulative air amount K=[G×f1]−[g×f2]

Load cumulative air amount determination equation: K>N1

Herein, "G" refers to the positive cumulative air amount at the determination time point, "g" refers to the negative cumulative air amount at the determination time point, "f1" refers to a positive correction factor and applies between 0 and 1 according to the specification of the engine system 1, "f2" refers to a negative correction factor and applies between 0 and 1 according to the specification of the engine system 1, "K" refers to the load cumulative air amount, "N1" refers to the threshold value indicating a reference value and is set to a proper value according to the specification of the engine system 1, "×" refers to a multiplication symbol of two values, and "−" refers to a subtraction symbol of two values.

As a result, when the load cumulative air amount K is greater than the threshold value N1, it enters into the thermostat fail determination control S60.

As described above, the applying the high operation load S52-1 to S55-1 and the applying the low operation load S52-2 to S55-2 enter into the thermostat fail determination control S60 at the load cumulative air amount K of a certain threshold value or more. However, the monitoring ECU 70 completely terminates all controls by determining as the thermostat diagnosis fail state (i.e., fail state) in order to prevent the continuous diagnosis when the actual coolant temperature is smaller than the diagnosis temperature (diagnosis temperature (threshold) of FIG. 7) at the load cumulative air amount K of a certain threshold value or more.

Figure 6:
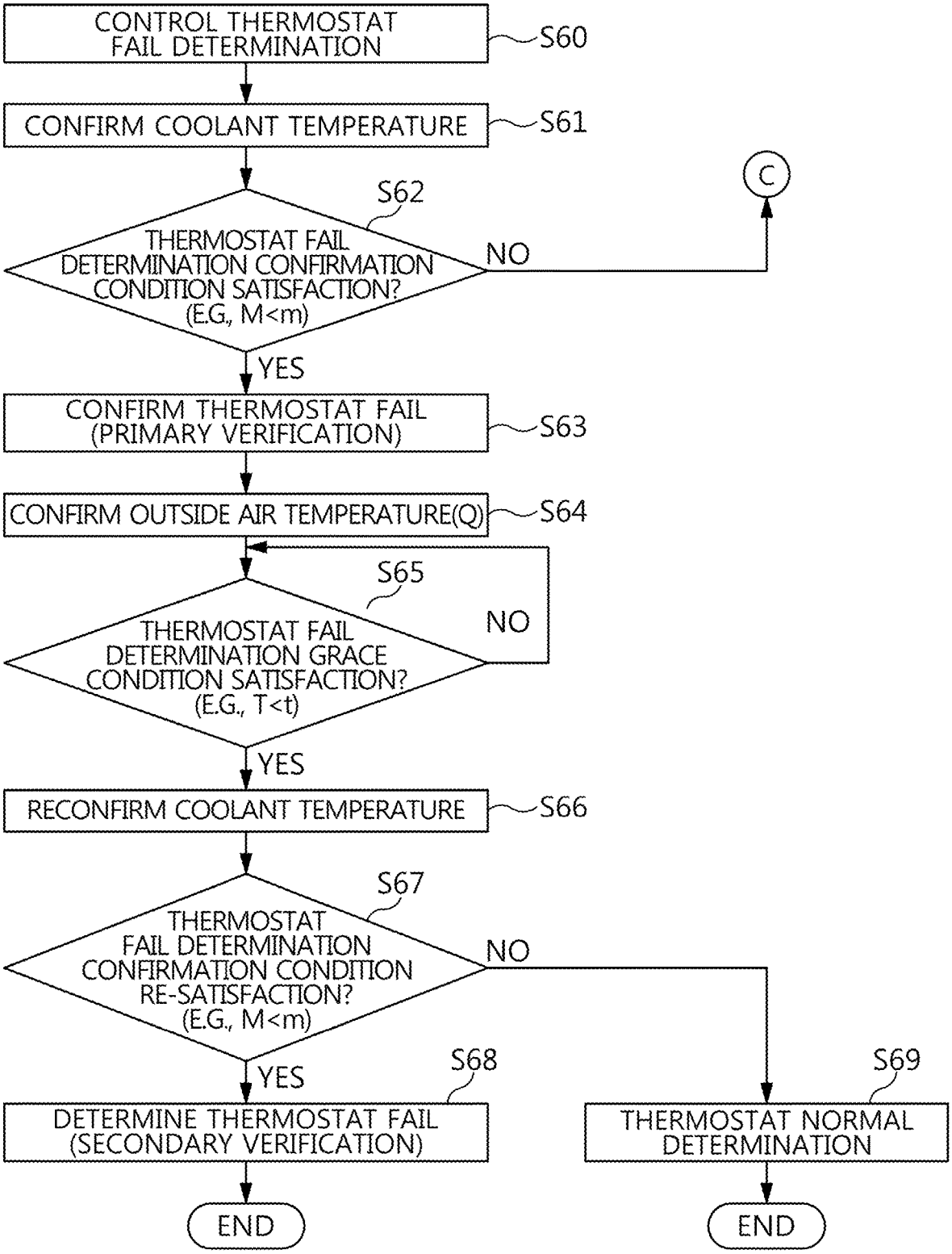
FIG. 6 is a flowchart illustrating a thermostat verification control for the thermostat misdiagnosis prevention control according to the present disclosure.

Referring to FIG. 6, the monitoring ECU 70 performs the thermostat fail determination control S60. In this case, the coolant temperature M and the threshold value m applied to the entry condition satisfaction equation S51 are applied in the confirmation condition satisfaction equation S62 and the confirmation condition re-satisfaction equation S67 in the same manner. However, practically the threshold value m of the entry condition satisfaction equation S51 is set to the reference value, the threshold value m of the confirmation condition satisfaction equation S62 is set to the determination value, and the threshold value m of the confirmation condition re-satisfaction equation S67 is set to the decision value to variously set these values, respectively.

Specifically, the thermostat fail determination control S60 is performed with applying thermostat fail determination confirmation conditions S61 and S62, confirming thermostat fail (primary verification) S63, applying thermostat fail determination grace conditions S64 and S65, reapplying thermostat fail determination confirmation conditions S66 and S67, determining thermostat fail (secondary verification) S68, and determining a thermostat normal S69.

Figure 7:
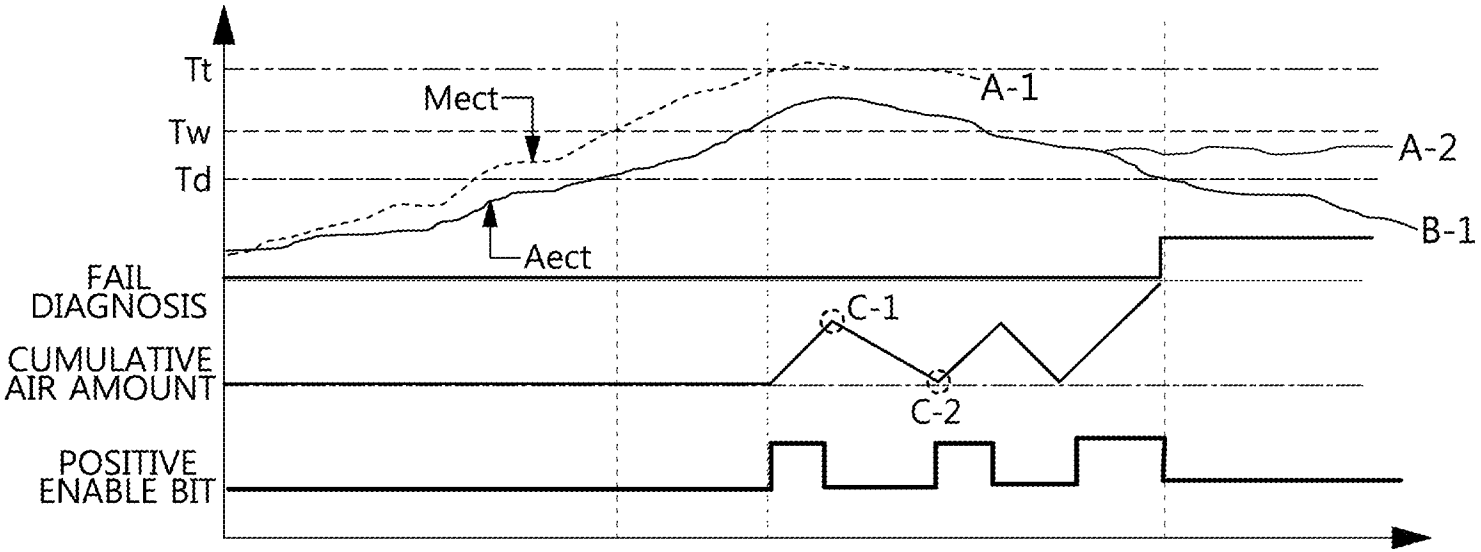
FIG. 7 is a diagram illustrating an example of the line diagram of the engine system of the two-step procedure divided into the thermostat diagnosis control and the thermostat verification control according to the present disclosure.

Particularly, the thermostat fail determination control S60 sets the case where the actual coolant temperature is equal to or greater than the diagnosis temperature (diagnosis temperature (threshold) of FIG. 7) as a primary diagnosis completion state (i.e., primary pass state), and in this state, performs the determination of a secondary diagnosis completion state (i.e., secondary pass state) in order to prevent the misdiagnosis of the thermostat fail. Therefore, the thermostat fail determination control S60 prevents the thermostat misdiagnosis by the thermostat continuous diagnosis (i.e., the two-step verification procedure of the primary and secondary determinations).

For example, the applying the thermostat fail determination confirmation conditions S61 and S62 is divided into confirming a coolant temperature S61 and determining thermostat fail determination confirmation condition satisfaction S62. The confirming the coolant temperature S61 is performed by the engine coolant temperature of the engine coolant data 66. The determining the thermostat fail determination confirmation condition satisfaction S62 applies a confirmation condition satisfaction equation.

Confirmation condition satisfaction equation: $M<m$

Herein, "M" refers to the engine coolant temperature detection value of the engine coolant data 66 at the determination time point, and "m" refers to the threshold value set as the On Board Diagnostics (OBD) thermostat diagnosis entry temperature having a specific value and is applied as the determination value.

As a result, when the coolant temperature M is greater than the threshold value m in the determining the thermostat fail determination confirmation condition satisfaction S62, the thermostat fail diagnosis is not necessary, thereby terminating the thermostat fail determination control S60.

On the other hand, when the coolant temperature M is smaller than the threshold value m in the determining the thermostat fail determination confirmation condition satisfaction S62, the thermostat fail is confirmed temporarily by the confirming the thermostat fail (primary verification) S63.

For example, the applying the thermostat fail determination grace conditions S64 and S65 is divided into confirming an outside air temperature S64 and determining thermostat fail determination grace condition satisfaction S65.

For example, the confirming the outside air temperature S64 is performed by reading the outside air temperature Q detected by the ambient air data 65. The determining the thermostat fail determination grace condition satisfaction S65 applies a matching time determination equation.

Matching time determination equation: $T=t$

Herein, "T" refers to a delay time in which the outside air temperature Q detected by a temperature sensor is maintained in the determining the thermostat fail (i.e., primary determination) S58, and "t" refers to a set delay time applied to the determining the thermostat fail (i.e., primary determination) S58 for each outside air temperature Q in the outside air temperature table of the thermostat diagnosis map 70-1. In this case, the outside air temperature Q applies 10° C.

As a result, it is confirmed that the delay time T and the set delay time t are the same through the matching time determination equation in the determining the thermostat fail determination grace condition satisfaction S65, and the detection of the outside air temperature Q continued during the delay time T matched with the set delay time t is determined by the thermostat fail determination grace condition satisfaction, thereby entering into the reapplying the thermostat fail determination confirmation conditions S66 and S67.

For example, the reapplying the thermostat fail determination confirmation conditions S66 and S67 is divided into reconfirming the coolant temperature S66 and determining the thermostat fail determination confirmation condition re-satisfaction S67. The reconfirming the coolant temperature S66 is performed with the engine coolant temperature of the engine coolant data 66. The determining the thermostat fail determination confirmation condition re-satisfaction S67 applies a confirmation condition re-satisfaction equation.

Confirmation condition re-satisfaction equation: $M<m$

Herein, "M" refers to the engine coolant temperature detection value of the engine coolant data 66 at the determination time point, and "m" refers to the threshold value set at the On Board Diagnostics (OBD) thermostat diagnosis entry temperature having a specific value and is applied as the decision value.

As a result, when the coolant temperature M is smaller than the threshold value m in the determining the thermostat fail determination confirmation condition re-satisfaction S67, it enters into the determining the thermostat fail (secondary verification) S68 to decide the thermostat fail.

On the other hand, when the coolant temperature M is greater than the threshold value m in the determining the thermostat fail determination confirmation condition re-satisfaction S67, it enters into the determining the thermostat normal S69 to ignore the confirming the thermostat fail (primary verification) S63.

Particularly, the monitoring ECU 70 may guide the thermostat fail in the determining the thermostat fail S68 and the thermostat normal in the determining the thermostat normal S69 on the driver seat cluster by using a text massage or lighting or voice.

Meanwhile, referring to FIG. 7, an engine system line diagram of the engine system 1 applying the thermostat fail-safe control S40 divided into the thermostat fail determination entry control S50 and the thermostat fail determination control S60 is exemplified.

As illustrated, from the actual ECT line diagram of the ECT 140, the thermostat fail is decided by the determining the thermostat fail (secondary verification) S68 through the determining the thermostat fail determination confirmation condition re-satisfaction S67 after the confirming the thermostat fail (primary verification) S63 has been performed in the determining the thermostat fail determination confirmation condition satisfaction S62. Therefore, the thermostat normal is decided by the thermostat primary warm-up diagnosis pass in the determining the thermostat fail determination confirmation condition satisfaction S62 or is decided by the continuous thermostat secondary warm-up continuous diagnosis pass in the determining the thermostat fail determination confirmation condition satisfaction S62 and the determining the thermostat fail determination confirmation condition re-satisfaction S67.

Particularly, from the load cumulative air amount line diagram applied to the thermostat fail determination entry control S50, the positive air amount calculation in the applying the high operation load S52-1 to S55-1 increases the load cumulative counter according to the high speed/high load conditions, while the negative air amount calculation in the applying the low operation load S52-2 to S55-2 applies the condition of reducing the load cumulative counter according to the low speed/low load conditions.

In addition, from the positive enable bit map line diagram for the determining the thermostat fail determination grace condition satisfaction S65, the signal generation of the thermostat fail diagnostic bit (e.g., bit=1) is performed in the positive air amount calculation in which the count is increased, while the signal generation of the thermostat fail diagnostic bit (e.g., bit=0) is not performed in the negative air amount calculation in which the count is reduced.

Therefore, the engine system line diagram applies the certain counter arrival conditions of the monitoring ECU 70 divided into the count increase of the applying the high operation load S52-1 to S55-1 and the count decrease of the applying the low operation load S52-2 to S55-2, thereby proving experimentally that the thermostat misdiagnosis, which occurred in the conventional method, is reliably blocked.

As described above, the thermostat misdiagnosis prevention method applied to the engine system 1 according to the present embodiment applies the high speed/high load and the low speed/low load, which are divided by the vehicle speed and the engine output detected from the engine system 1 at the engine warm-up temperature of the engine coolant in the monitoring ECU 70, as the monitoring conditions of the thermostat 40, and reliably determining the thermostat fail by primarily determining the thermostat fail with the engine coolant temperature of the engine coolant temperature and the outside air temperature detected from the engine system 1, then confirming the delay time with respect to the outside air temperature, and secondarily determining the thermostat fail with the engine coolant temperature.

Therefore, the thermostat misdiagnosis prevention method may prevent the misdiagnosis of the thermostat 40 by the fail-safe using the continuous monitoring, and particularly, may diagnose the thermostat fail by the verification of the primary and secondary determinations through the traveling conditions of the high speed/high load distinguished from low speed/low load in which the air circulation inside the engine is weak, thereby corresponding to the enhanced OBD together with preventing the thermostat misdiagnosis.

While a number of exemplary aspects have been discussed above, those of skill in the art will recognize that still further modifications, permutations, additions and sub-combinations thereof of the disclosed features are still possible. It is therefore intended that the following appended claims and claims hereafter introduced are interpreted to include all such modifications, permutations, additions and sub-combinations as are within their true spirit and scope.

The invention claimed is:

1. A thermostat misdiagnosis prevention method, comprising:

controlling an engine warm-up determination for an engine, and when the warm-up of the engine has been completed, controlling a thermostat fail determination entry by an engine load-based load cumulative air amount, and wherein controlling the thermostat fail determination by the confirmation of thermostat fail is performed by a monitoring ECU upon operation of an engine system;

wherein controlling the thermostat fail determination entry divides a process of the monitoring ECU into high speed/high load and low speed/low load by engine information applied to the monitoring ECU;

wherein controlling the thermostat fail determination entry includes:

determining the load cumulative air amount by using a positive cumulative air amount according to the high speed/high load and a negative cumulative air amount according to the low speed/low load; and controlling the fail determination entry when the load cumulative air amount exceeds a specific value; and wherein the load cumulative air amount is calculated by a difference value between a corrected positive cumulative air amount and a corrected negative cumulative air amount, and the thermostat fail determination entry compares the difference value with a threshold.

2. The thermostat misdiagnosis prevention method of claim 1, wherein a thermostat is switched to a valve open state by setting an engine warm-up temperature as a target regulating temperature, and the thermostat fail is detected in the valve open state.

3. The thermostat misdiagnosis prevention method of claim 1, wherein the engine information comprises at least one of an engine RPM, an engine output, an intake air amount, a vehicle speed, an outside air temperature, an engine coolant temperature, engine combustion, and an engine temperature is detected by the monitoring ECU in the engine system.

4. The thermostat misdiagnosis prevention method of claim 3, wherein the vehicle speed and the engine output are applied to divide the high speed/high load and the low speed/low load in controlling the thermostat fail determination entry.

5. The thermostat misdiagnosis prevention method of claim 3, wherein the engine coolant temperature and the outside air temperature are applied in controlling the thermostat fail determination.

6. The thermostat misdiagnosis prevention method of claim 1, wherein the determining the positive cumulative air amount comprises:

determining whether to satisfy a first intake air amount corresponding to the high speed/high load conditions; and updating a positive air cumulative air amount storage value to the positive cumulative air amount by using the first intake air amount when satisfying the first intake air amount; and wherein the determining the negative cumulative air amount comprises:

determining whether to satisfy a second intake air amount corresponding to the low speed/low load conditions; and updating a negative cumulative air amount storage value to the negative cumulative air amount by using the second intake air amount when satisfying the second intake air amount;

wherein the satisfaction of the first intake air amount is the sum of an air amount detection value and the positive cumulative air amount storage value; and wherein the satisfaction of the second intake air amount is the sum of an air amount detection value and the negative cumulative air amount storage value.

7. The thermostat misdiagnosis prevention method of claim 5, wherein controlling the thermostat fail determination includes performing a primary determination for the thermostat fail with the engine coolant temperature, confirming the thermostat fail by the primary determination, determining thermostat fail determination grace condition satisfaction with a delay time according to the outside air temperature in the primary determination state, performing a secondary determination for the thermostat fail with the engine coolant temperature, and determining the thermostat fail by the secondary determination.

8. The thermostat misdiagnosis prevention method of claim 7, wherein the primary determination is performed by comparing the engine coolant temperature with a thermostat diagnosis entry temperature threshold of an On Board Diagnostics (OBD.

9. The thermostat misdiagnosis prevention method of claim 7, wherein the thermostat fail determination grace condition satisfaction is confirmed when the outside air temperature persists during a delay time.

10. The thermostat misdiagnosis prevention method of claim 7, wherein the secondary determination is performed by comparing the engine coolant temperature with a thermostat diagnosis entry temperature threshold of an On Board Diagnostics (OBD).

11. An engine system, comprising:

a monitoring ECU configured to execute the method of claim 1, wherein the monitoring ECU for applying a high speed/high load and a low speed/low load, which are divided by a vehicle speed and an engine output detected after an engine warm-up temperature determination, as monitoring conditions of a thermostat, and determining a thermostat fail by primarily determining the thermostat fail based on the engine coolant temperature of the detected engine coolant temperature and secondarily the outside air temperature, then confirming a delay time with respect to the outside air temperature, and reconfirming the thermostat fail with the engine coolant temperature; and a water-cooled cooling system for circulating the engine coolant into an engine through an engine coolant line in which the thermostat is installed.

12. The engine system of claim 11, wherein the monitoring ECU comprises a monitoring block in which an enable monitoring flag starting the monitoring for the thermostat is generated, and the monitoring block receives engine information comprising an engine RPM, an engine load, an intake air amount, engine combustion, and an engine temperature together with the vehicle speed, the engine output, the engine coolant temperature, and the outside air temperature.

13. The engine system of claim 12, wherein the monitoring ECU further comprises an engine model block for generating a model engine temperature flag by the vehicle speed, the engine load, the outside air temperature, the engine combustion, and the engine temperature, and a fault detection block for determining the thermostat fail by detecting the engine coolant temperature while receiving the enable monitoring flag and the model engine temperature flag.

14. The engine system of claim 12, wherein the monitoring ECU is connected with a thermostat diagnosis map, and the thermostat diagnosis map comprises an outside air temperature table, a low speed/low load table, a high speed/high load table, a monitoring table, and a thermostat fail diagnosis table.

* * * * *